US009623693B2

(12) United States Patent
Katayama

(10) Patent No.: US 9,623,693 B2
(45) Date of Patent: Apr. 18, 2017

(54) PRINTER COVER LOCKING MECHANISM

(71) Applicant: SATO HOLDINGS KABUSHIKI KAISHA, Tokyo (JP)

(72) Inventor: Tamotsu Katayama, Tokyo (JP)

(73) Assignee: SATO HOLDINGS KABUSHIKI KAISHA (JP)

( * ) Notice: Subject to any disclaimer, the term of this patent is extended or adjusted under 35 U.S.C. 154(b) by 0 days.

(21) Appl. No.: 14/780,139

(22) PCT Filed: Oct. 25, 2013

(86) PCT No.: PCT/JP2013/079004

§ 371 (c)(1),
(2) Date: Sep. 25, 2015

(87) PCT Pub. No.: WO2014/155800

PCT Pub. Date: Oct. 2, 2014

(65) Prior Publication Data

US 2016/0052319 A1 Feb. 25, 2016

(30) Foreign Application Priority Data

Mar. 26, 2013 (JP) ..... 2013-063671

(51) Int. Cl.
*B41J 29/56* (2006.01)
*E05C 19/00* (2006.01)
(Continued)

(52) U.S. Cl.
CPC ..... *B41J 29/56* (2013.01); *B41J 15/042* (2013.01); *B41J 29/13* (2013.01); *E05C 19/00* (2013.01)

(58) Field of Classification Search
CPC .. E05C 19/00; B41J 29/13; B41J 29/56; B41J 15/042
See application file for complete search history.

(56) References Cited

U.S. PATENT DOCUMENTS 4,498,794 A * 2/1985 Waibel ..... B41J 13/03 400/629
2003/0076401 A1 4/2003 Mori et al. ..... 347/215
(Continued)

FOREIGN PATENT DOCUMENTS

JP H 07-46538 2/1995
JP H 09-290546 11/1997
(Continued)

OTHER PUBLICATIONS

International Search Report dated Jan. 28, 2014 issued in corresponding International patent application No. PCT/JP2013/079004.

*Primary Examiner* — Stephen Meier
*Assistant Examiner* — Alexander D Shenderov
(74) *Attorney, Agent, or Firm* — Ostrolenk Faber LLP

(57) ABSTRACT

A printer cover locking mechanism has a reduced number of parts and may be assembled in a small space, by simplification of a print head (thermal head (13)) mechanism, a cover lock (27) mechanism relating to opening and closing of an opening and closing cover (3), and a heat dissipation mechanism for a print head (13). The cover lock (27) also serves as a heat dissipation plate. A printer cover locking mechanism includes the opening and closing cover (3) that opens and closes with respect to a printer housing (2). A print head (13) for printing on print paper (continuous label body (4)), a platen roller (14) for feeding a print paper (4) by sandwiching the print paper (4) between the platen roller (14) and the print head (13), and a cover lock (27) for causing the print head (13) to contact with and separate from the platen roller (14) by engaging with and disengaging from the platen roller (14), respectively. The print head (13) is attached on the cover lock (27), and the cover lock (27) is capable of dissipating heat generated from the print head (13).

25 Claims, 5 Drawing Sheets

(51) Int. Cl.
*B41J 29/13* (2006.01)
*B41J 15/04* (2006.01)

(56) References Cited

U.S. PATENT DOCUMENTS

| | | | | |
|---|---|---|---|---|
| 2008/0003040 | A1* | 1/2008 | Sekino | B41J 3/60 400/188 |
| 2008/0111876 | A1 | 5/2008 | Sasaki et al. | |
| 2009/0290010 | A1 | 11/2009 | Nureki et al. | 347/220 |
| 2010/0141728 | A1* | 6/2010 | Takabatake | B41J 11/006 347/220 |
| 2011/0074903 | A1* | 3/2011 | Takahashi | B41J 2/32 347/198 |
| 2011/0128341 | A1* | 6/2011 | Takahashi | B41J 2/32 347/220 |
| 2011/0182647 | A1 | 7/2011 | Kawaguchi | 400/642 |

FOREIGN PATENT DOCUMENTS

| | | | |
|---|---|---|---|
| JP | 2004-195805 | | 7/2004 |
| JP | 2008-62597 | | 3/2008 |
| JP | 2008-93948 | | 4/2008 |
| JP | 2008-119925 | | 5/2008 |
| JP | 2009-279810 | A | 12/2009 |
| JP | 2011-148240 | A | 8/2011 |

* cited by examiner

PRINTER COVER LOCKING MECHANISM

CROSS-REFERENCE TO RELATED APPLICATIONS

The present application is a 35 U.S.C. §§371 national phase conversion of PCT/JP2013/079004, filed Oct. 25, 2013, which claims priority of Japanese Patent Application No. 2013-063671 filed, filed Mar. 26, 2013, the contents of which are incorporated by reference herein. The PCT International Application was published in the Japanese language.

TECHNICAL FIELD

The present disclosure relates to a printer cover locking mechanism. In particular, the present disclosure relates to a printer locking mechanism capable of reducing a number of parts and conserving assembly space.

BACKGROUND ART

Conventionally, there has been a need for print paper to be stored inside a printer housing by disengaging an opening and closing cover or the like, in order to load a continuous label body strip or another type of print paper onto various types of printers such as a desktop printer or a portable printer. A cover lock that acts as an engaging and disengaging lock of an opening and closing cover, or the like has been proposed.

Moreover, a mechanism surrounding a print head in a printing part of a printer includes various complex parts such as a head-attaching member or a heat dissipation plate. Accordingly, a cost thereof is increased and an assembly space thereof is enlarged. In addition, the abovementioned mechanism surrounding the print head and the abovementioned mechanism surrounding the cover lock have both been in need of a more simplified configuration.

However, while miniaturizing the entire portable printer is particularly desirable, a problem exists where a heat dissipation mechanism must ensure dissipation of heat generated in the print head.

RELATED ART

Patent Literature

Patent Literature 1: JP-UM-B-H7-046538

SUMMARY OF THE INVENTION

Problems to be Solved by the Invention

A present disclosure has been conceived of in view of various conventional problems. As a result, a printer cover locking mechanism that is capable of reducing a number of parts and conserving assembly space is proposed.

The present disclosure proposes a printer cover locking mechanism in which a mechanism surrounding a print head is further simplified.

The present disclosure proposes a printer cover locking mechanism in which a mechanism surrounding a cover lock related to an opening and closing of an opening and closing cover is further simplified.

The present disclosure proposes a printer cover locking mechanism in which a heat dissipation mechanism of a print head is further simplified.

Means for Solving the Problems

In other words, the present disclosure focuses on a cover lock for the opening and closing of an opening and closing cover that has a function the same as that of the conventional heat dissipation plate. As a result, the printer cover locking mechanism includes: a printer housing; an opening and closing cover configured to open and close with respect to the printer housing; a print head attached to one of: the printer housing or the opening and closing cover, the print head capable of printing on print paper loaded into the printer housing; a platen roller attached to another of: the printer housing or the opening and closing cover, the platen roller capable of feeding the print paper by sandwiching and rotating the print paper between the print head and the platen roller; and a cover lock configured to cause the print head to contact with the platen roller by engaging with the platen roller and configured to cause the print head to separate from the platen roller by disengaging from the platen roller. The cover lock is attached to the print head, and allows dissipation of heat generated from the print head.

A push-release button is operated to separate the platen roller from the print head may be further included.

An abutting inclined plate that opposes the push-release button may be included, with the abutting inclined plate integrated with the cover lock.

A platen roller lock engaging part may be formed on the cover lock, the platen roller lock engaging part configured to engage with the lock pin and disengage from the lock pin, with the lock pin attached to a printer shaft of the platen roller.

A tapered surface may be formed on the cover lock, with the tapered surface abutting against the lock pin attached to the printer shaft of the platen roller.

The abutting inclined plate of the cover lock may incline in a direction that approaches a rear surface side of the press-release button.

The abutting inclined plate of the cover lock may be positioned in a vicinity of an ejection port that dispenses the print paper printed by the print head to outside of the printer housing.

A spring-attaching protrusion may be formed on the cover lock, with the spring-attaching protrusion attached to a head-biasing spring biasing the print head in a direction toward the platen roller, and a recess that opposes the print head may be formed on an inner wall surface of the spring-attaching protrusion.

A material of the cover lock may be an iron material having a plated surface.

The print head may be attached to the printer housing, and the platen roller may be attached to the opening and closing cover.

Effects of the Invention

A printer cover locking mechanism according to the present disclosure has a heat dissipating function in a cover lock attached to a print head. As a result, it is not necessary to provide a conventionally required heat dissipation plate. Therefore, the number of parts may be reduced, the assembly space may be conserved, the cost may be decreased, and the printer may be miniaturized.

DETAILED DESCRIPTION OF THE INVENTION

The present disclosure describes that a cover lock attached to a print head has a heat dissipating function. As a result, a printer cover locking mechanism allows for a reduction in number of parts, a conservation of assembly space, and a decrease in cost, and a miniaturization of the printer to be achieved.

Embodiments

Figure 1:
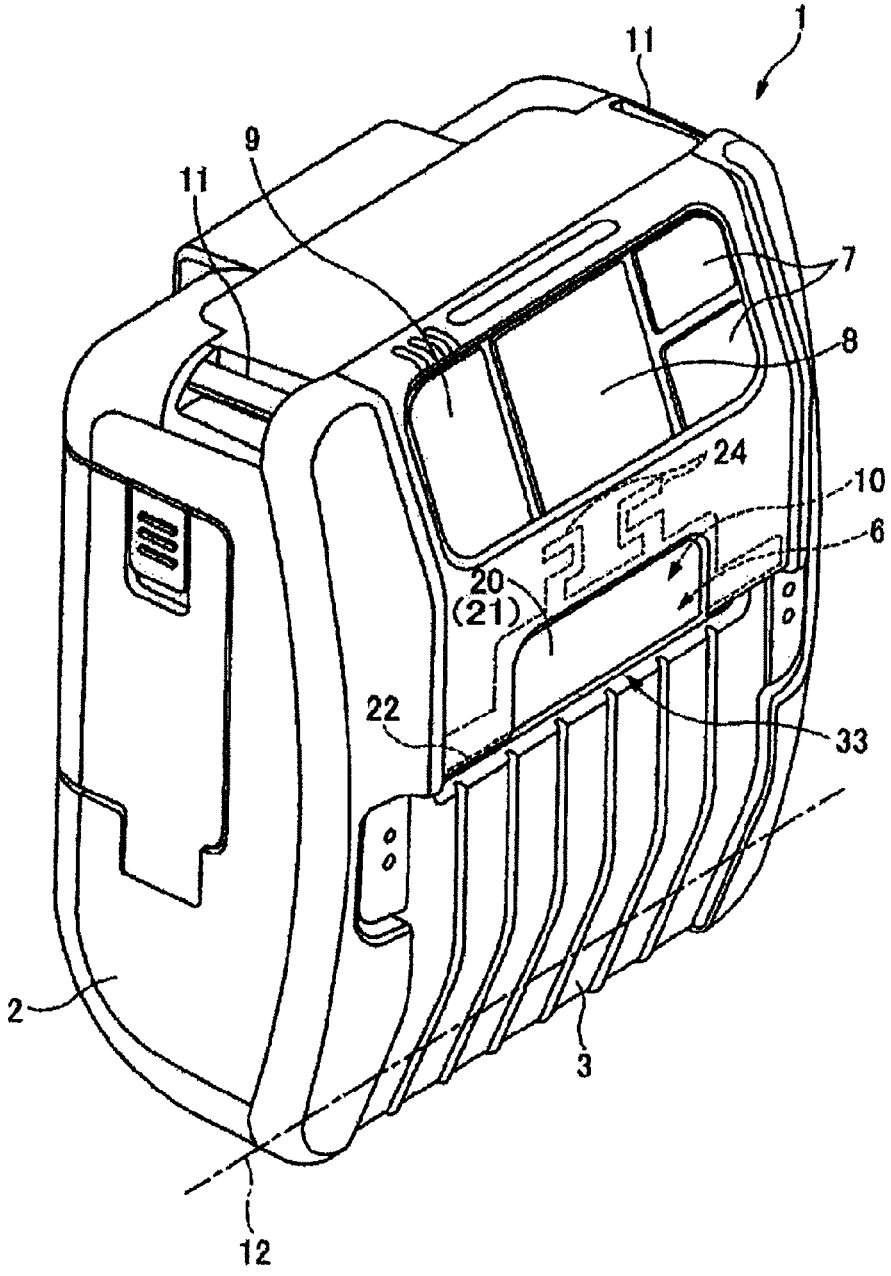
FIG. 1 shows a perspective view of a portable printer 1 equipped with a cover locking mechanism 10 according to an embodiment of a present disclosure.
Figure 2:
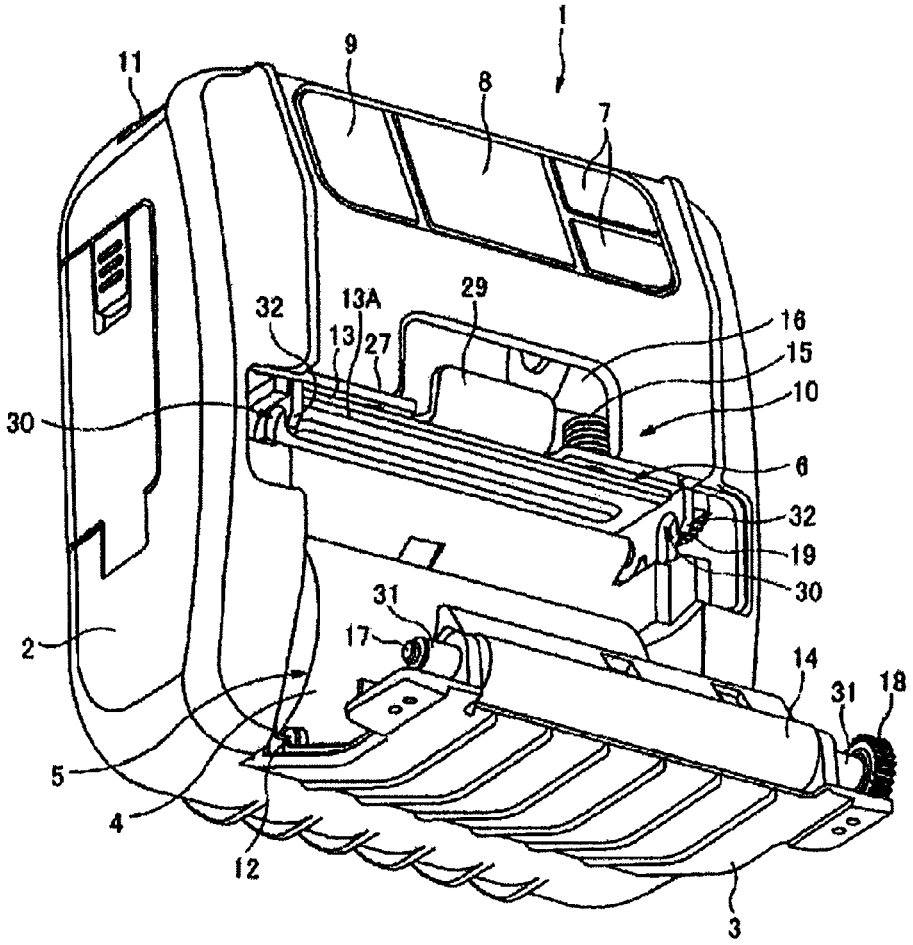
FIG. 2, similarly, shows a perspective view of an opening and closing cover 3 of the portable printer 1, in an opened condition with respect to a printer housing 2.

Next, a description based on FIGS. 1 to 5 of the printer cover locking mechanism according to an embodiment of the present disclosure will be described. FIG. 1 shows a perspective view of the printer, e.g., a portable printer 1. The portable printer 1 is a thermal printer. The portable printer 1 includes: a printer housing 2; and an opening and closing cover 3. FIG. 2 shows a perspective view of an opening and closing cover 3 of the portable printer 1, in an opened condition with respect to a printer housing 2. The portable printer 1 further includes: a feeding part 5 of a roll-shaped continuous label body 4 (print paper); a printing part 6; an inputting part 7; a displaying part 8; a power switch 9; and a cover locking mechanism 10.

The printer housing 2 has an operator-portable size. In FIG. 1, a belt-hanging part 11 is included on an upper side, and the entire portable printer 1 is hangable from a shoulder of an operator by a shoulder-hanging belt (not shown). Of course, the entire portable printer 1 is also attachable to a waist of the operator. Further, in a printer housing 2 in FIG. 1, an opening and closing cover surrounding a cover shaft 12 positioned at a lower corner part may open and close. As a result, it is possible for storing the continuous label body 4 in the feeding part 5 and for loading into the portable printer 1.

The continuous label body 4 has a plurality of label pieces temporarily attached onto a strip-shaped mount or backing strip. The label piece is a so-called "thermal label." It is possible to print by coating a thermosensitive color developing layer onto a surface of the label piece. It is possible for the feeding part 5 to store the continuous label body 4 in an inner part of the feeding part by winding the continuous label body 4 into a rolled shape, and to unwind the continuous label body 4 into a strip shape in a direction toward the printing part 6.

The printing part 6 includes: a thermal head 13 attached to the printer housing 2; a platen roller 14 attached to a side of the opening and closing cover 3, and that allows for feed of the continuous label body 4; a head-biasing spring 15 configured to bias the thermal head 13 in a direction toward the platen roller 14; and a driving motor 16. A platen roller gear 18 included at a tip part on one side of a platen roller shaft 17 of the platen roller 14, and a connecting gear 19 configured to transmit a rotation of the driving motor 16 to a side of the printer housing 2. The platen roller gear 18 and the connecting gear 19 are mutually engaged by closing the printer housing 2 of the opening and closing cover 3, and the platen roller 14 may be rotary driven by the driving motor 16.

In other words, thermal printing is applied to the continuous label body 4 (label piece) by sandwiching the continuous label body 4 between the thermal head 13 and the platen roller 14, by rotary driving the platen roller 14 via the driving motor 16, and by having the heating element 13A of the thermal head 13 generate heat in response to print data fed into the thermal head 13.

The inputting part 7 is able to input a necessary data or command into the portable printer 1. The displaying part 8 is able to display information input by the inputting part 7 and other required information.

Figure 3:
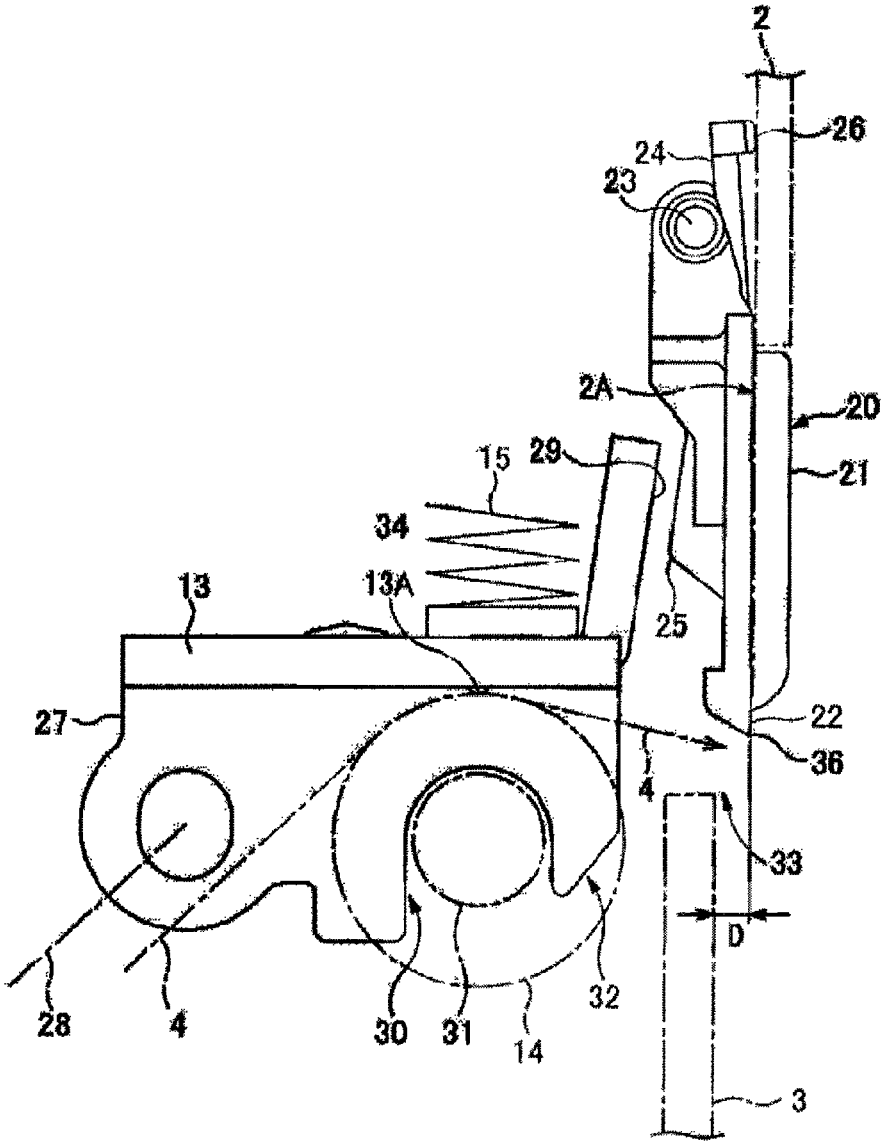
FIG. 3, similarly, shows a cross-sectional view of a main part of a cover locking mechanism 10 (push-release button 20)

Next, a push-release button 20 is included in the printer housing 2, and the cover locking mechanism 10 according to the present embodiment is included in an inner part of the push-release button 20. FIG. 3 shows a cross-sectional view of a main part of a cover locking mechanism 10 (push-release button 20). The push-release button 20 includes: a button body 21; a water-proof adhesive surface 22 formed around a whole circumference of a rim part of the button body 21; a button shaft 23 and a button-biasing spring 24 as an elastic member that are integrated with the button body 21; and a push-protrusion 25 projecting from a rear surface side of the button body 21.

The button body 21 is exposed on a surface side of the printer housing 2, as shown in FIG. 1. The button body 21 is pressed by an operator using the portable printer 1 towards an inner side of the printer housing 2 (from a right direction to a left direction in FIG. 3).

The water-proof adhesive surface 22 is formed such that the water-proof adhesive surface 22 is sunken in relatively more on an inner side of the printer housing 2 than the button body 21. The water-proof adhesive surface 22 may be positioned on an inner side of the printer housing 2. The water-proof adhesive surface 22 is a flat surface region that is in close contact with an inner wall surface 2A of the printer housing 2. In particular, as indicated by a broken line in FIG. 1, the water-proof adhesive surface 22 extends along a lengthwise direction of a thermal head 13 (width direction of continuous label body 4), so as to be longer than a peak. The water-proof adhesive surface 22 may cover the whole heating element 13A (see, FIG. 2) of the thermal head 13.

A left and right button shaft 23 is attached to an inner bracket (not shown) of the printer housing 2. The left and right button shaft 23 may rotate the whole push-release button 20 with respect to the printer housing 2 by pressing the button body 21.

A left and right button-biasing spring 24 is formed at a tip part of the push-release button 20 by winding along the same plane as the water-proof adhesive surface 22 (see, a broken line of FIG. 1). Moreover, the left and right button-biasing spring 24 is configured to raise an abutting shaft part 26 to each tip part thereof located at a region extending from the button body 21 past the left and right button shaft 23. As shown in FIG. 3 in particular, when each abutting shaft part 26 abuts against the inner wall surface 2A of the printer housing 2 it bends the left and right button-biasing spring 24 such that the water-proof adhesive surface 22 may be brought into close contact with the inner wall surface 2A of the printer housing 2 by a biasing force exerted via the warping of the left and right button-biasing spring 24. In other words, the left and right button shaft 23 of the push-release button 20 is positioned between the left and right button-biasing spring 24 and the water-proof adhesive surface 22, such that the left and right button-biasing spring 24 may bias the push-release button 20, to bring the water-proof adhesive surface 22 into close contact with the inner wall surface 2A of the printer housing 2. It may be possible to achieve a required length to obtain a specified biasing force within a narrow space by forming the left and right button-biasing spring 24 in winding manner. In addition, integrating the button-biasing spring 24 with the button body 21 has an advantage for the portable printer 1 in particular, because miniaturization is needed.

Figure 4:
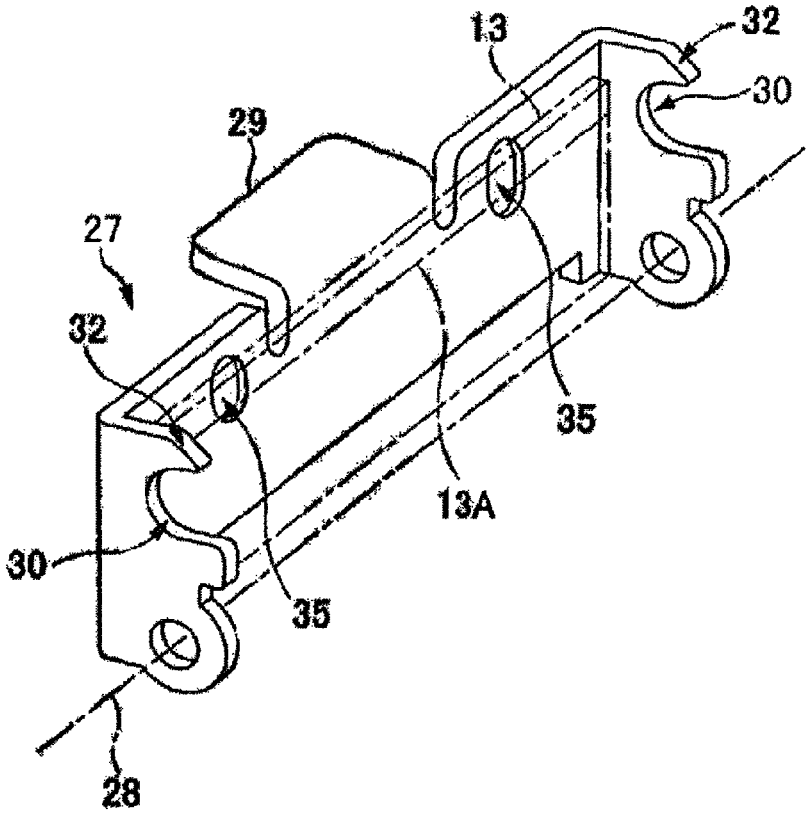
FIG. 4, similarly, shows a perspective view of a cover lock 27.
Figure 5:
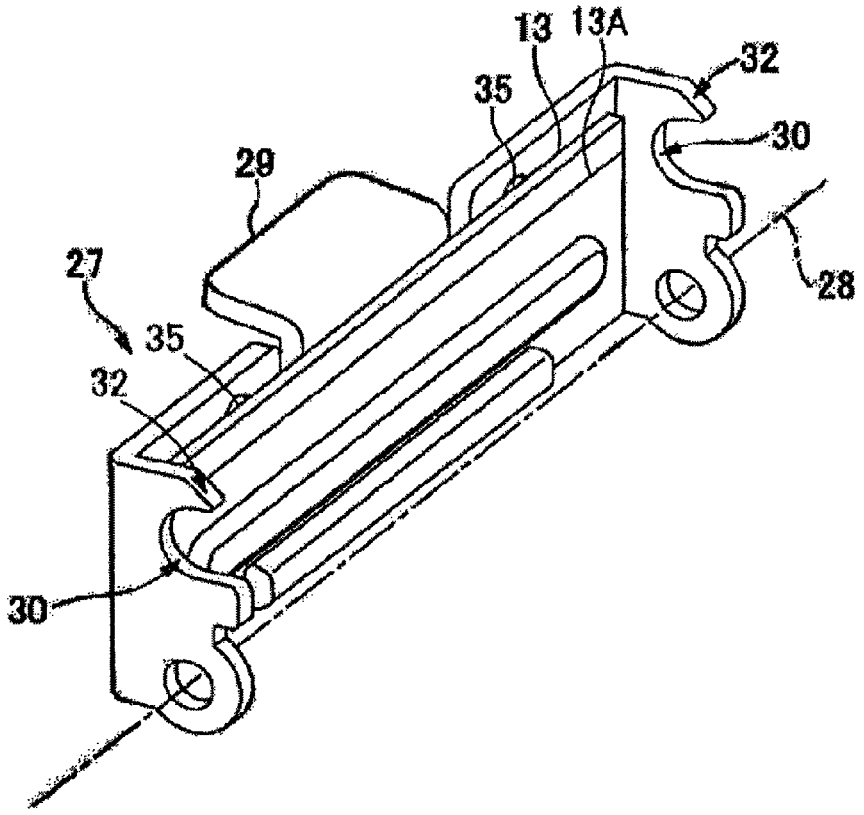
FIG. 5, similarly, shows a perspective view indicating an integrated structure of a cover lock 27 and a thermal head 13.

As shown in FIG. 3 in particular, the cover lock 27 may rotate around the head shaft 28 on a rear surface side (inner side of the printer housing 2) of the push-release button 20. FIG. 4 shows a perspective view of the cover lock 27. FIG. 5 shows a perspective view indicating an integrated structure of the cover lock 27 and the thermal head 13. As shown in FIGS. 4 and 5, the thermal head 13 is attached and fixed to the cover lock 27 by an adhesive agent.

The abutting inclined plate 29 is integrally formed in a region that faces towards the push-protrusion 25 (FIG. 3) and is positioned at a center of an upper frame part of cover lock 27. In addition, a left and right platen roller lock engaging part 30 having a section that is substantially semi-circular arc-shaped is formed on a side opposing the push-protrusion 25 via the thermal head 13. The abutting inclined plate 29 of the cover lock 27 inclines in a direction that approaches a rear surface side of the push-release button 20. In other words, the abutting inclined plate 29 of the cover lock 27 inclines towards an initial pressing direction (orthogonal direction that faces an inner side of the printer housing 2) of the push-release button 20 with respect to the printer housing 2. Accordingly, a component of a force working in a rotating operation of the cover lock 27 surrounding the head shaft 28 may be made relatively large via an affect from the push-release button 20 (push-protrusion 25) on the abutting inclined plate 29 of the cover lock 27. The force that is necessary to operate the push-release button 20 may be relatively small.

The left and right platen roller lock engaging part 30 may be engaged with and disengaged from by the left and right lock pin 31 of the platen roller 14. During closing of the opening and closing cover 3, the platen roller 14 is able to abut against the thermal head 13 via application of a specified pressing force (printing pressure) while the left and right lock pin 31 are engaged with the left and right platen roller lock engaging part 30. Printing may be accomplished with the continuous label body 4 sandwiched by the platen roller 14 and the thermal head 13.

The push-protrusion 25 located on a rear surface side of the button body 21 opposes the abutting inclined plate 29 of the cover lock 27. The push-protrusion 25 presses the abutting inclined plate 29 via a rotation in a clockwise direction of the push-release button 20 surrounding the left and right button shaft 23 by resisting a biasing force of the left and right button-biasing spring 24, as shown in FIG. 3. Moreover, the thermal head 13 and the cover lock 27 rotate surrounding the head shaft 28 by resisting the biasing force of the head-biasing spring 15 in a counter-clockwise direction, as shown in FIG. 3. Accordingly, the left and right lock pin 31 of the platen roller 14 are separated from the left and right platen roller lock engaging part 30, and the thermal head 13 is separated from the platen roller 14, such that the continuous label body 4 may be loaded. As a result, the cover lock 27 may be separated from the platen roller 14 via the abutting inclined plate 29 by the rotation of the push-release button 20.

Further, a tapered surface 32 is formed on an upper tip part of the left and right platen roller lock engaging part 30. Thus, the left and right lock pin 31 of the platen roller 14 easily engage with the left and right platen roller lock engaging part 30 after abutting against the tapered surface 32 during a closing operation of the opening and closing cover 3.

As a result, the cover lock 27 attached to the thermal head 13 causes the platen roller 14 to contact with the thermal head 13 by engaging with the platen roller 14 and causes the platen roller 14 to separate from the thermal head 13 by disengaging from the platen roller 14 resulting from closing and opening of the opening and closing cover 3, respectively. Further, the cover lock 27 may directly dissipate heat generated from the thermal head 13. In other words, a material of the cover lock 27 is an iron material. Plate processing with such as zinc or chrome is applied to a surface of the iron material. Thus, the material of the cover lock 27 may dissipate the heat of the thermal head 13 and may have rigidity or mechanical strength, which may allow engagement with or disengagement from the left and right lock pin 31 of the platen roller 14. Further, the plate processing applied to the iron material may prevent from generating rust caused by rainwater, humidity, or the like, in the portable printer 1 that may be used in outdoor.

In addition, the abutting inclined plate 29 of the cover lock 27 inclines in a direction that approaches towards the rear surface side of the push-release button 20, and the abutting inclined plate 29 is positioned in a vicinity of an ejection port 33 that dispenses the continuous label body 4 printed by the thermal head 13 to an outside of the printer housing 2. Accordingly, a heat dissipation effect is improved because the abutting inclined plate 29 is easily exposed to outside air. Of course, every time the opening and closing cover 3 (platen roller 14) is opened and separated from the thermal head 13 via operation of the push-release button 20, a part that forms a tapered surface 32 and the left and right platen roller lock engaging part 30 of the cover lock 27 is exposed to an outer part with the thermal head 13. Accordingly, a heat dissipation effect may be similarly improved.

The left and right spring-attaching protrusion 34 (see, FIG. 3) which is attached to the head-biasing spring 15 that biases the thermal head 13 in the direction toward the platen roller 14 is formed on the cover lock 27. In addition, the recess 35 (see, FIGS. 4 and 5) that opposes the thermal head 13 is formed on the inner wall surface of each of the left and right spring-attaching protrusion 34. Consequently, a surface area of part of the left and right spring-attaching protrusion 34 may be increased, and a heat dissipation effect may be improved.

As indicated in FIG. 3 in particular, a lower side tip part of the water-proof adhesive surface 22 of the push-release button 20 is a tip part 36 for cutting paper. The tip part for cutting paper 36 opposes the continuous label body 4 that is fed to the ejection port 33 from between the thermal head 13 and the platen roller 14. The continuous label body 4 (mount and label piece) may be cut at a predetermined region thereof.

Further, as shown in FIG. 3 in particular, the portable printer 1 is portable such that the thermal head 13 is positioned further above the platen roller 14. As shown in FIG. 3 in particular, the lower side tip part of the push-release button 20 (tip part for cutting paper 36) is positioned slightly more on an outer side than on an outer surface (see, space D shown in FIG. 3) of a tip part of the opening and closing cover 3. Accordingly, air between the cover lock 27 and the ejection port 33 of a printed continuous label body 4 does not readily accumulate, and a heat dissipation effect may be smoothly achieved by the cover lock.

In the cover locking mechanism 10 of the portable printer 1 of the present configuration, as shown in FIG. 2, in order to open the opening and closing cover 3 that is shown closed in FIG. 1, it is necessary to press the push-release button 20 to the inside of the printer housing 2 against a biasing force of the left and right button-biasing spring 24 (see, FIG. 3). As a result of pressing the push-release button 20, as previously described, the platen roller 14 and the opening and closing cover 3 are both opened, as shown in FIG. 2, by disengaging the left and right platen roller lock engaging part 30 and the left and right locking 31, such that the continuous label body 4 may be inserted and loaded between the thermal head 13 and the platen roller 14. In a case where the roll-shaped continuous label body 4 is stored inside the feeding part 5 while the platen roller 14 and the opening and closing cover 3 are both opened, and the opening and closing cover 3 is closed in a direction toward the printer housing 2, the left and right lock pin 31 of the platen roller 14 abut against the tapered surface 32 of the cover lock 27. In a case where the opening and closing cover 3 (platen roller 14) is further pushed against the biasing force of the head-biasing spring 15 in a closing direction, the left and right lock pin 31 may engage with the left and right platen roller lock engaging part 30, the opening and closing cover 3 may be closed, and the continuous label body 4 may be sandwiched between the thermal head 13 and the platen roller 14.

The thermal head 13 is directly attached to the cover lock 27. Therefore, a number of parts is reduced, and heat generated from the thermal head 13 is directly received by the cover lock 27 via a heat conduction effect. As previously described, the cover lock 27 also has heat dissipating function of the heat dissipation plate. Thus, the assembly space may be conserved, and the portable printer 1 may be miniaturized.

Of course, a cover locking mechanism according to the present disclosure may also be applied to a desktop printer or the other type of printer.

Moreover, the above embodiment describes a structure, in which a print head (thermal head 13) is attached to the printer housing 2, the platen roller 14 is attached to the opening and closing cover 3, and the push-release button 20 may rotate with respect to the printer housing 2. However, in the present disclosure, a flexibility of design may be improved by selecting an arbitrary combination for each part or relative relationship therebetween. For example, the print head (thermal head 13) may be attached to the opening and closing cover 3, and the platen roller 14 may be attached to the printer housing 2. In addition, the push-release button 20 may rotate towards the opening and closing cover 3.

DESCRIPTION OF REFERENCE NUMERALS

1 Portable printer;
2 Printer housing;
3 Opening and closing cover;
4 Continuous label body (print sheet);
5 Feeding part;
6 Printing part;
7 Inputting part;
8 Displaying part;
9 Power switch;
10 Cover locking mechanism of portable printer 1 (Embodiment, and FIG. 3);
11 Belt-hanging part;
12 Cover shaft of the opening and closing cover 3;
13 Thermal head (print head);
13A Heating element of thermal head 13;
14 Platen roller;
15 Head-biasing spring;
16 Driving motor;
17 Platen roller shaft of the Platen roller 14;
18 Platen roller gear of the Platen roller 14;
19 Connecting gear;
20 Push-release button;
21 Button body of the push-release button 20;
22 Water-proof adhesive surface of the push-release button 20;
23 Button shaft of the push-release button 20;
24 Button-biasing spring of the push-release button 20;
25 Push protrusion of the push-release button 20;
26 Abutting shaft part of the button-biasing spring 24;
27 Cover lock;
28 Head shaft of the thermal head 13;
29 Abutting inclined plate of the cover lock 27;
30 Platen roller lock engaging part of the cover lock 27;
31 Lock pin of the platen roller 14;
32 Tapered surface of the cover lock 27;
33 Ejection port;
34 Spring-attaching protrusion of the cover lock 27;
35 Recess of the spring-attaching protrusion;
36 Tip part for cutting paper; and
D Space between tip part for cutting paper of the push-release button 20 and outer surface of tip part of the opening and closing cover 3.

The invention claimed is:

1. A printer comprising:
a printer housing;
an opening and closing cover configured to open and close with respect to the printer housing;
a print head attached to one of the printer housing or the opening and closing cover, the print head configured for printing on print paper loaded into the printer housing;
a platen roller attached to another of the printer housing or the opening and closing cover, the platen roller configured for feeding the print paper by rotating while sandwiching the print paper between the print head and the platen roller; and
a plate including a center portion and two side portions extending from the both ends of the center portion, the center portion contacting the print head, the side portions configured to engage with the both ends of the platen roller.

2. The printer according to claim 1, further comprising a push-release button to be operated to separate the platen roller from the print head, wherein
the plate further includes a protruding portion that protrudes from the center portion, the protruding portion configured to abut against the push-release button.

3. The printer according to claim 2, wherein the protruding portion inclines towards to the push-release button.

4. The printer according to claim 2, wherein the push-release button comprises a button body and a contact surface that is sunken-in on an inner side of the printer housing relatively more than the button body, and the contact surface is a planar area configured to be adhered to an inner wall surface of the printer housing.

5. The printer according to claim 1, further comprising an ejection port configured for ejecting the print paper printed by the print head to the outside of the printer housing, wherein the protruding portion inclines towards to the ejection port.

6. The printer according to claim 1, further comprising a push-release button to be operated to separate the platen roller from the print head by the rotation thereof, and a cover lock separated from the platen roller via the plate by the rotation of the push-release button.

7. The printer according to claim 6, wherein the push-release button comprises a button body and a contact surface being recessed from the button body, and the contact surface is a planar area configured to be adhered to the inner side of the printer housing.

8. The printer according to claim 1, further comprising a cover lock configured to contact and fix the print head while the opening and closing cover closes.

9. A printer cover locking mechanism comprising:

a printer housing;

an opening and closing cover configured to open and close with respect to the printer housing;

a print head attached to the printer housing, the print head configured for printing on a print paper loaded into the printer housing;

a platen roller attached to the opening and closing cover, the platen roller configured to feed the print paper by rotating while sandwiching the print paper between the print head and the platen roller; and a cover lock configured to rotate with respect to the printer housing to engage and disengage with the platen roller, the cover lock configured to cause the print head to contact with the platen roller by engaging with the platen roller, the cover lock configured to cause the print head to separate from the platen roller by disengaging from the platen roller, the cover lock being attached to the print head, the cover lock configured for allowing dissipation of heat generated from the print head, the cover lock including a spring-attaching protrusion attached to a head-biasing spring which biases the print head in a direction toward the platen roller.

10. The printer cover locking mechanism according to claim 9, wherein the cover lock contacts with the print head to dissipate the heat.

11. The printer cover locking mechanism according to claim 9, wherein the cover lock is directly attached to the print head, the cover lock is made of metal, the head-biasing spring is a metal coil spring, and the head-biasing spring is directly attached to the spring-attaching protrusion.

12. The printer cover locking mechanism according to claim 9, wherein the cover lock has a first surface and a second surface that is opposed to the first surface, the spring-attaching protrusion is provided on the first surface, and the print head is attached to the second surface.

13. The printer cover locking mechanism according to claim 9, further comprising a push-release button to be operated to separate the platen roller from the print head.

14. The printer cover locking mechanism according to claim 13, wherein the cover lock comprises an inclined plate that is opposed to the push-release button, the inclined plate being integrated with the cover lock.

15. The printer cover locking mechanism according to claim 14, wherein the inclined plate inclines in the direction toward the rear surface side of the push-release button.

16. The printer cover locking mechanism according to claim 14, wherein the inclined plate is located in the vicinity of an ejection port configured to eject a print paper printed by the print head outside the printer housing.

17. The printer cover locking mechanism according to claim 9, wherein the cover lock comprises a platen roller locking engagement portion configured to engage and disengage with a lock pin that is attached to a printer shaft of the platen roller.

18. The printer cover locking mechanism according to claim 9, wherein the cover lock comprises a tapered surface configured to abut on a lock pin that is attached to a printer shaft of the platen roller.

19. A printer cover locking mechanism comprising:

a printer housing;

an opening and closing cover configured to open and close with respect to the printer housing;

a print head attached to one of the printer housing or the opening and closing cover, the print head configured for printing on a print paper loaded into the printer housing;

a platen roller attached to another of the printer housing or the opening and closing cover, the platen roller configured to feed the print paper by rotating while sandwiching the print paper between the print head and the platen roller;

a push-release button; and a cover lock configured to cause the print head to contact with the platen roller by engaging with the platen roller, the cover lock configured to cause the print head to separate from the platen roller by disengaging from the platen roller, the cover lock including an inclined plate configured to abut on the push-release button, the inclined plate integrated with the cover lock.

20. The printer cover locking mechanism according to claim 19, wherein the inclined plate inclines in such a manner that the tip end side thereof firstly abuts on the rear surface of the push-release button when the push-release button is pushed.

21. The printer cover locking mechanism according to claim 19, wherein the inclined plate inclines in the direction toward the rear surface side of the push-release button.

22. The printer cover locking mechanism according to claim 19, wherein the cover lock is rotatably supported, and the push-release button presses the inclined plate so as to separate the print head from the platen roller when the push-release button is pushed.

23. The printer cover locking mechanism according to claim 19, wherein the push-release button comprises a button body and a contact surface being recessed from the button body, and the contact surface is a planar area configured to be adhered to the inner side of the printer housing.

24. The printer cover locking mechanism according to claim 19, wherein the print head is directly attached to the cover lock.

25. The printer cover locking mechanism according to claim 19, wherein whole of the rear surface of the print head contact with the cover lock.

* * * * *